US010574004B2

(12) United States Patent
Akita et al.

(10) Patent No.: US 10,574,004 B2
(45) Date of Patent: Feb. 25, 2020

(54) CABLE AND POWER SUPPLY DEVICE

(71) Applicant: SONY CORPORATION, Tokyo (JP)

(72) Inventors: Yuichi Akita, Fukushima (JP); Tomohiro Koga, Saitama (JP)

(73) Assignee: SONY CORPORATON, Tokyo (JP)

( * ) Notice: Subject to any disclaimer, the term of this patent is extended or adjusted under 35 U.S.C. 154(b) by 132 days.

(21) Appl. No.: 15/314,968

(22) PCT Filed: Mar. 23, 2015

(86) PCT No.: PCT/JP2015/001599
§ 371 (c)(1),
(2) Date: Nov. 30, 2016

(87) PCT Pub. No.: WO2015/190020
PCT Pub. Date: Dec. 17, 2015

(65) Prior Publication Data

US 2017/0201050 A1 Jul. 13, 2017

(30) Foreign Application Priority Data

Jun. 13, 2014 (JP) ..... 2014-122570

(51) Int. Cl.
*H01R 13/713* (2006.01)
*H01B 11/00* (2006.01)
(Continued)

(52) U.S. Cl.
CPC ..... *H01R 13/7137* (2013.01); *H01B 11/00* (2013.01); *H01R 13/6683* (2013.01); *H01R 24/64* (2013.01); *H01R 2107/00* (2013.01)

(58) Field of Classification Search
CPC ..... H01R 13/7137; H01R 13/6683; H01R 2107/00; H01R 24/64; H01R 31/065; H01R 13/70; H02H 5/04; H01B 11/00
See application file for complete search history.

(56) References Cited

U.S. PATENT DOCUMENTS

2010/0315752 A1* 12/2010 Rabu ..... H01R 13/6683 361/103
2011/0104940 A1* 5/2011 Rabu ..... H01R 13/7137 439/502
(Continued)

FOREIGN PATENT DOCUMENTS

JP 62-093874 A 4/1987
JP 05-159828 A 6/1993
(Continued)

OTHER PUBLICATIONS

Wikipedia, "Dock Connector", Revision published on Oct. 22, 2015, retrieved from https://en.wikipedia.org/w/index.php?title=Dock_connector&oldid=687011148 on Jan. 22, 2019 (Year: 2015).*

*Primary Examiner* — Ryan Johnson
(74) *Attorney, Agent, or Firm* — Chip Law Group

(57) ABSTRACT

A cable includes: a cable part that includes a power supply line forming a power line; a connector that is provided on at least one of one end and another end of the cable part; and a circuit board that has a protection circuit including a temperature detection element and a switch that accepts a detection result of the temperature detection element to perform an operation of switchably conducting and interrupting the power line.

5 Claims, 12 Drawing Sheets

(51) Int. Cl.

| | |
|---|---|
| ***H01R 13/66*** | (2006.01) |
| ***H01R 24/64*** | (2011.01) |
| *H01R 107/00* | (2006.01) |

(56) References Cited

U.S. PATENT DOCUMENTS

| | | | | |
|---|---|---|---|---|
| 2015/0288110 | A1* | 10/2015 | Taniguchi | H01R 13/46 439/620.22 |
| 2016/0006190 | A1* | 1/2016 | Katsuura | H02H 5/04 439/502 |
| 2017/0110837 | A1* | 4/2017 | Taniguchi | G06F 13/409 |

FOREIGN PATENT DOCUMENTS

| | | | |
|---|---|---|---|
| JP | 07-067245 | A | 3/1995 |
| JP | 09-223547 | A | 8/1997 |
| JP | 10-320056 | A | 12/1998 |
| JP | 10-326646 | A | 12/1998 |
| JP | 2003-092516 | A | 3/2003 |
| JP | 2014-056678 | A | 3/2014 |
| JP | 2014-075333 | A | 4/2014 |
| WO | 2004/030027 | A2 | 4/2004 |
| WO | 2009/019801 | A1 | 2/2009 |
| WO | 2013/069107 | A1 | 5/2013 |

* cited by examiner

CABLE AND POWER SUPPLY DEVICE

CROSS REFERENCE TO RELATED APPLICATIONS

This application is a U.S. National Phase of International Patent Application No. PCT/JP2015/001599 filed on Mar. 23, 2015, which claims priority benefit of Japanese Patent Application No. JP 2014-122570 filed in the Japan Patent Office on Jun. 13, 2014. Each of the above-referenced applications is hereby incorporated herein by reference in its entirety.

TECHNICAL FIELD

The present technology relates to a cable and a power supply device.

BACKGROUND ART

A cable such as a USB cable is used to transmit and receive data between electronic devices. The USB cable or the like is also used to supply power from a host device to another device. Moreover, a power supply unit such as a USB charging-compatible AC adapter supplies power to an electronic device via the cable such as the USB cable connected to the power supply unit.

Patent Document 1 proposes a technology that prevents a failure or the like of a device by turning off a power supply thereof in the event of an abnormal increase in temperature.

CITATION LIST

Patent Document

Patent Document 1: Japanese Patent Application Laid-Open No. 2003-92516

SUMMARY OF THE INVENTION

Problems to be Solved by the Invention

As for the cable, in the event of the abnormal increase in temperature caused by a short circuit or the like, it is sought to protect at least the cable by interrupting the current.

Therefore, an object of the present technology is to provide a cable and a power supply device capable of protecting at least the cable when there occurs an abnormal increase in temperature.

Solutions to Problems

In order to solve the aforementioned problem, according to an aspect of the present technology, there is provided a cable including: a cable part that includes a power supply line forming a power line; a connector that is provided on at least one of one end and another end of the cable part; and a circuit board that has a protection circuit including a temperature detection element and a switch that accepts a detection result of the temperature detection element to perform an operation of switchably conducting and interrupting the power line.

According to another aspect of the present technology, there is provided a cable including: a cable part that includes a power supply line forming a power line; a connector that is provided on at least one of one end and another end of the cable part; and a conductive member that is provided on the power line to switchably conduct and interrupt the power line by undergoing a change in shape following a change in temperature.

According to another aspect of the present technology, there is provided a cable including: a cable part that includes a power supply line forming a power line; a connector that is provided on at least one of one end and another end of the cable part; and a conductive member that causes a positive power line and a negative power line to be short circuited by undergoing a change in shape following a change in temperature.

According to another aspect of the present technology, there is provided a power supply device including a power supply source and at least one of the aforementioned cables connected to the power supply source.

Effects of the Invention

According to the present technology, at least the cable can be protected in the event of the abnormal increase in temperature.

Figure 1:
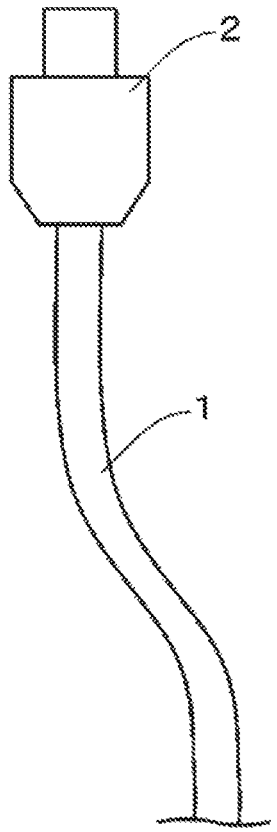
FIG. 1 is a schematic diagram illustrating an example of the configuration of a cable according to a first embodiment of the present technology.

MODES FOR CARRYING OUT THE INVENTION (Technical Background of Present Technology)

A technical background of the present technology will be described first in order to facilitate understanding of the present technology. With the release of a Battery Charging Specification, Revision 1.2 (BC 1.2), a power supply standard using a universal serial bus (USB) is expanded to 1.5 A and is in the process of supporting larger current with the advent of a USB-Power Delivery (PD), a manufacturer-specific standard and the like. On the other hand, a connector of a USB cable is generally a compact one such as a micro-USB, where a short circuit or the like is likely to occur due to deformation of a terminal, deformation and deterioration inside the cable, and/or intrusion of a foreign matter into the terminal. A value of overcurrent protection of a charger is increased as the larger current is supported, thereby causing burning or the like of the cable due to abnormal heating more frequently on the market. Heating by the short circuit occurs locally so that it is required to promptly detect abnormal temperature and protect the cable as well as a power supply source connected to the cable and a device connected to the cable to receive power supply.

Embodiments of the present technology will now be described with reference to the drawings. The description will be provided in the following order. Among all the drawings of the embodiments, parts that are identical or correspond to each other will be assigned the same reference numeral.

1. First Embodiment
2. Second Embodiment
3. Third Embodiment
4. Fourth Embodiment
5. Another Embodiment (Variation)

Note that the embodiments and the like described below are specific examples preferred in the present technology, the content of which is not to be limited to these embodiments and the like. Moreover, the effects described in the present specification are given by way of illustration only and not by way of limitation or to deny the existence of an effect different from the effects being illustrated.

1. First Embodiment

There will be described an example of the configuration of a cable according to a first embodiment of the present technology. FIG. 1 is a schematic diagram illustrating an example of the configuration of the cable according to the first embodiment of the present technology. As illustrated in FIG. 1, the cable according to the first embodiment of the present technology includes a cable part 1, a connector 2 and a substrate 3 on which a protection circuit is mounted. The cable according to the first embodiment of the present technology is, for example, a USB cable such as a micro-USB cable. The cable according to the first embodiment of the present technology can for example be used as an output cable while being connected to a power supply source such as a USB adapter, an AC adapter or a power supply. Note that the power supply can, for example, be a power supply with a built-in battery such as a portable power supply equipped with a USB output function, the battery being a lithium ion polymer battery or the like.

The connector 2 is provided at one end of the cable part 1. A connector different in type from the connector 2 is provided at another end of the cable part 1. The substrate 3 is incorporated in the connector 2. Note that the substrate 3 may be incorporated across both the cable part 1 and the connector 2. The entire connector is heated quickly when a connector shell 12 and a connector terminal are short circuited by a conductive foreign matter or the like, so that it is effective for a temperature detection element (the substrate 3) to be incorporated in the connector 2.

Figure 2:
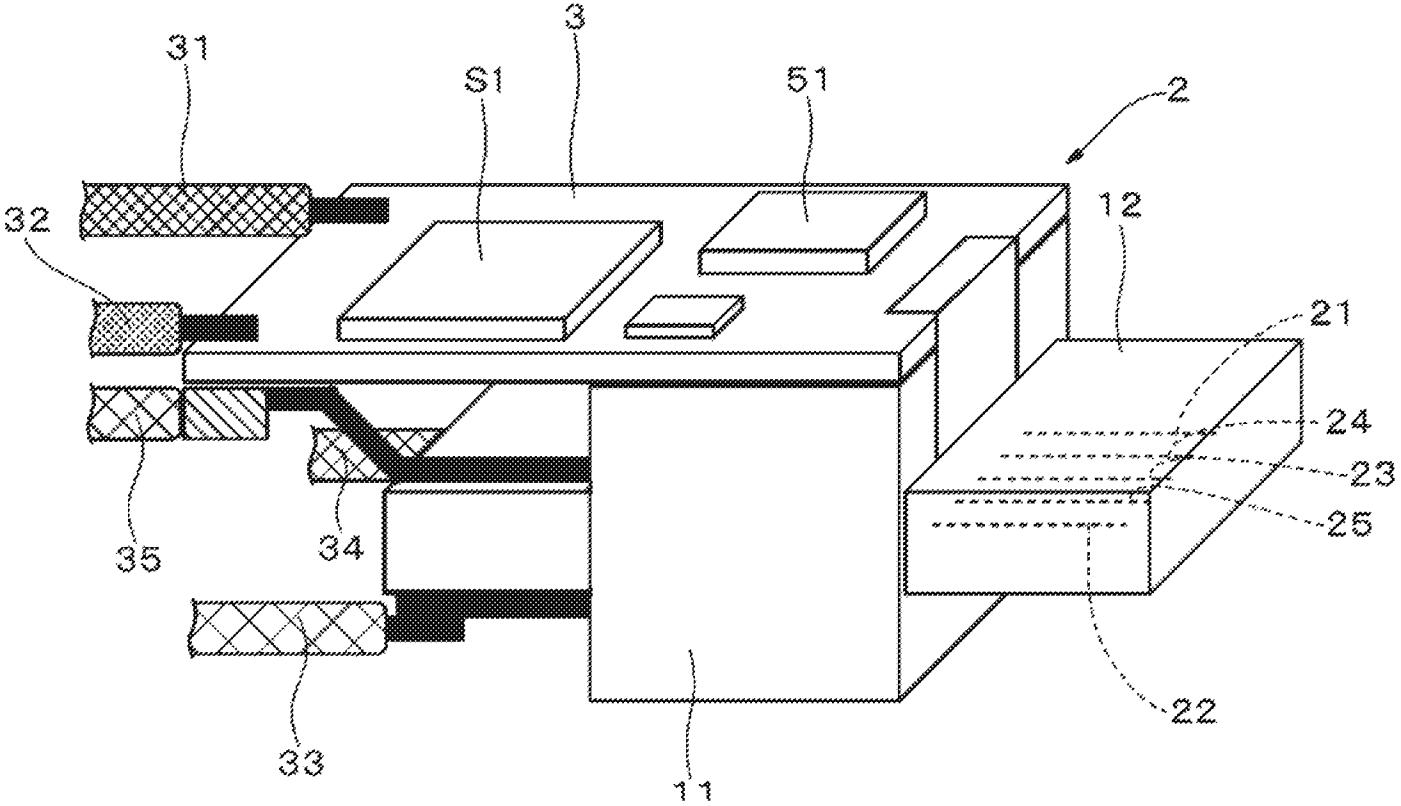
FIG. 2 is a schematic diagram illustrating a schematic configuration of a connector provided at one end of a cable part.
Figure 3:
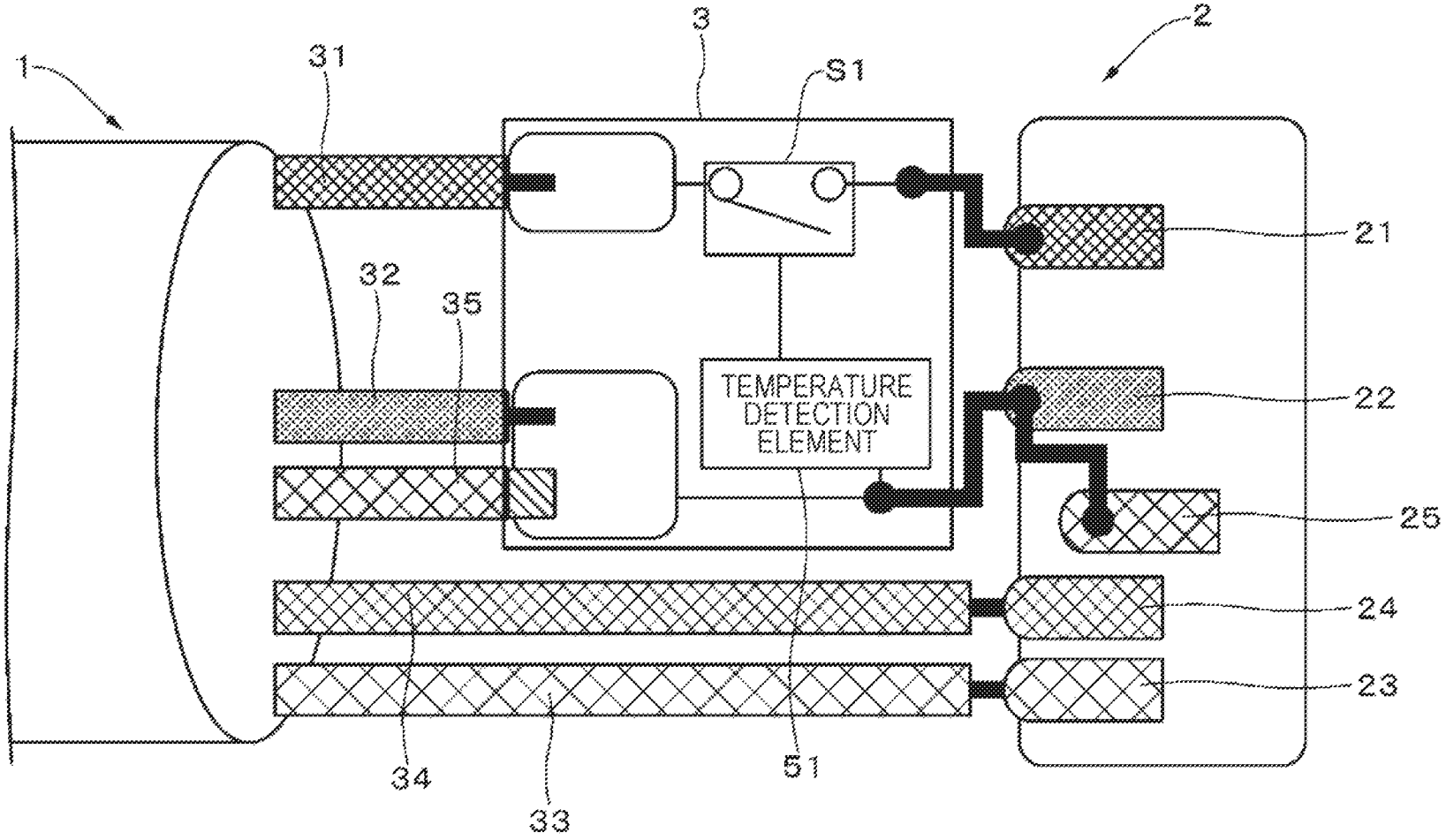
FIG. 3 is a schematic diagram illustrating a schematic electrical configuration of the cable.

FIG. 2 is a schematic diagram illustrating a schematic configuration of the connector provided at the one end of the cable part 1. FIG. 3 is a schematic diagram illustrating a schematic electrical configuration of the cable. The connector 2 includes a connector body 11 made of synthetic resin or the like, the connector shell 12 made of sheet metal and attached to the connector body 11, and the substrate 3. Although not shown in the drawings, these parts are coated with resin such that a tip of the connector shell 12 is exposed.

Connector terminals including a VBUS terminal 21, a GND terminal 22, a D+ terminal 23, a D− terminal 24 and an ID terminal 25 are arranged side by side in a projecting portion of the connector body 11 covered with the connector shell 12.

The cable part 1 includes a VBUS line 31 forming a positive power line and a GND line 32 forming a negative power line as power supply lines, a D+ line 33 and a D− line 34 as two positive and negative data communication lines for signal transmission, and a shield line 35.

The D+ terminal 23 is electrically connected to the D+ line 33. The D− terminal 24 is electrically connected to the D− line 34. The shield line 35 is electrically connected to the connector shell 12.

The VBUS line 31 and the GND line 32 are connected to the substrate 3 on which the protection circuit is mounted, where the VBUS line 31 is electrically connected to the VBUS terminal 21 via the substrate 3 while the GND line 32 is electrically connected to the GND terminal 22 via the substrate 3.

The protection circuit includes a switch S1 and a temperature detection element 51 such as a thermistor. The switch S1 is provided on the positive power line to switchably conduct and interrupt the positive power line. When the temperature detection element 51 connected to the switch S1 detects an abnormal increase in temperature, the switch S1 is turned off to interrupt the positive power line. As a result, at least the cable can be protected against the abnormal increase in temperature caused by abnormal heating or the like. For example, the cable as well as the power supply source (such as the USB adapter, the AC adapter or the power supply) connected to the cable and a device connected to the cable to receive power supply can be protected against the abnormal increase in temperature caused by the abnormal heating or the like.

Figure 4:
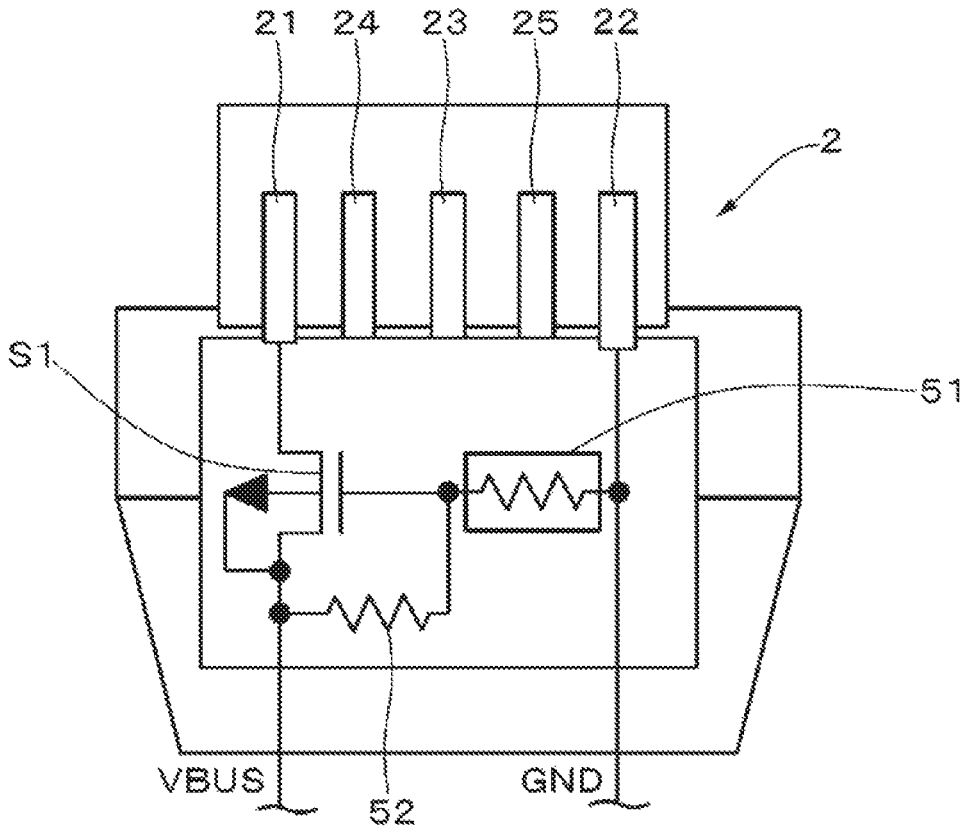
FIG. 4 is a schematic diagram illustrating a specific configuration of a protection circuit.

FIG. 4 more specifically illustrates an example of the configuration of the protection circuit corresponding to the protection circuit illustrated in FIG. 3. Note that the configuration of the protection circuit is not limited to the example illustrated in FIG. 4. As illustrated in FIG. 4, the positive power line (VBUS line) is provided with a metal oxide semiconductor field effect transistor (MOSFET) as the switch S1, for example, and a resistance 52 is connected in parallel with the MOSFET. Moreover, the thermistor as the temperature detection element 51 is connected to the MOSFET. The thermistor is a positive temperature coefficient (PTC) thermistor, the resistance of which increases as temperature increases (having a positive temperature coefficient), for example. In the example illustrated in FIG. 4, a resistance value of the thermistor increases as temperature increases abnormally, so that the MOSFET is turned off to interrupt the positive power line. At least the cable can thus be protected against the abnormal increase in temperature. For example, the cable as well as the power supply source connected to the cable and the device connected to the cable to receive power supply can be protected against the abnormal increase in temperature caused by the abnormal heating or the like.

[Variation 1-1]

(Example Where Arrangement of Substrate is Changed)

The example of the cable according to the first embodiment may also be adapted such that the arrangement of the substrate 3 is changed as follows.

Figure 5:
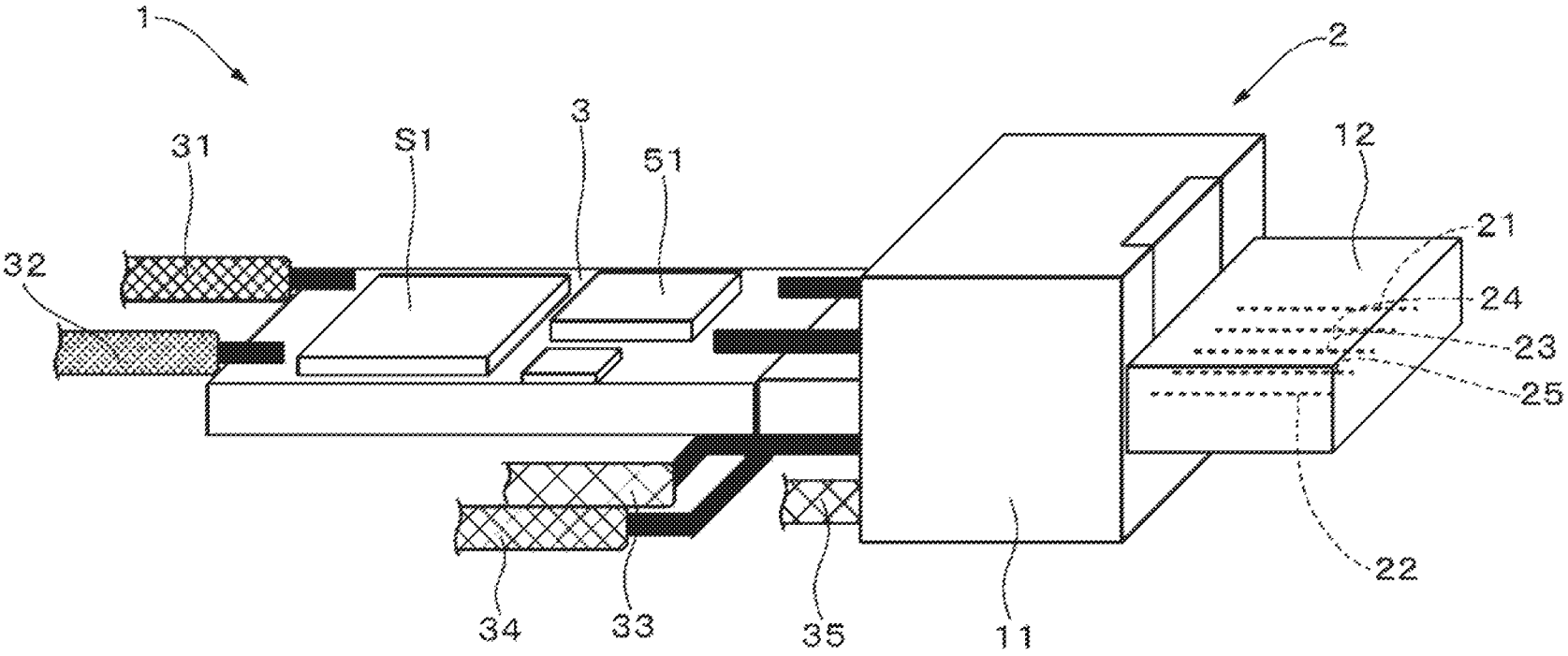
FIG. 5 is a schematic diagram illustrating a schematic configuration of a cable according to variation 1-1.

FIG. 5 is a schematic diagram illustrating a schematic configuration of a cable according to variation 1-1. As with the aforementioned example of the cable, the cable according to variation 1-1 includes a cable part 1, a connector 2 and a substrate 3 on which a protection circuit is mounted. The connector 2 is provided at one end of the cable part 1. A connector different in type from the connector 2 is provided at another end of the cable part 1. In variation 1-1, the substrate 3 is incorporated not in the connector 2 but in the cable part 1. When a point of contact of a connector terminal with the cable is short circuited by a conductive foreign matter, for example, the point of contact of the connector terminal with the cable tends to be heated faster than the entire connector. The substrate 3 is thus effectively incorporated in the cable part 1 (preferably in the vicinity of the connector 2) to be able to detect such heating more quickly and perform protection promptly. The rest is similar to the aforementioned example of the cable.

[Variation 1-2]

(First Example of Another Configuration of Protection Circuit)

The example and variation 1-1 of the cable according to the first embodiment may also be adapted such that the configuration of the protection circuit is changed as follows.

Figure 6:
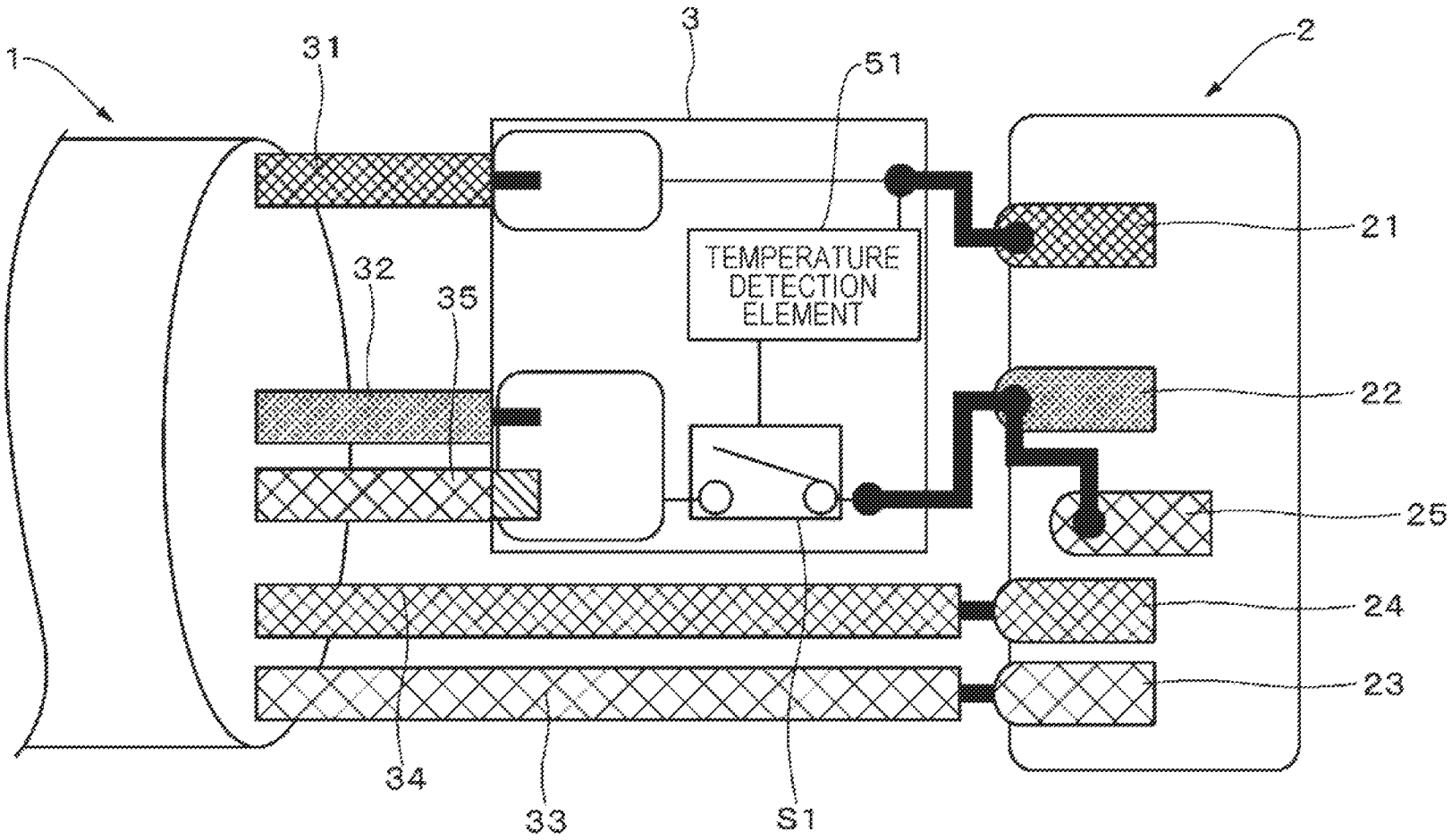
FIG. 6 is a schematic diagram illustrating a first example of another configuration of the protection circuit.

FIG. 6 is a schematic diagram illustrating a first example of another configuration of the protection circuit. In variation 1-2, a switch S1 is provided on a negative power line to switchably conduct and interrupt the negative power line. When a temperature detection element 51 connected to the switch S1 detects an abnormal increase in temperature, the switch S1 is turned off to interrupt the negative power line. At least the cable can thus be protected against the abnormal increase in temperature. For example, the cable as well as a power supply source connected to the cable and a device connected to the cable to receive power supply can be protected against the abnormal increase in temperature caused by abnormal heating or the like. The rest is similar to the aforementioned example and variation 1-1 of the cable.

[Variation 1-3]

(Second Example of Another Configuration of Protection Circuit) The example and variation 1-1 of the cable according to the first embodiment may also be adapted such that the configuration of the protection circuit is changed as follows.

Figure 7:
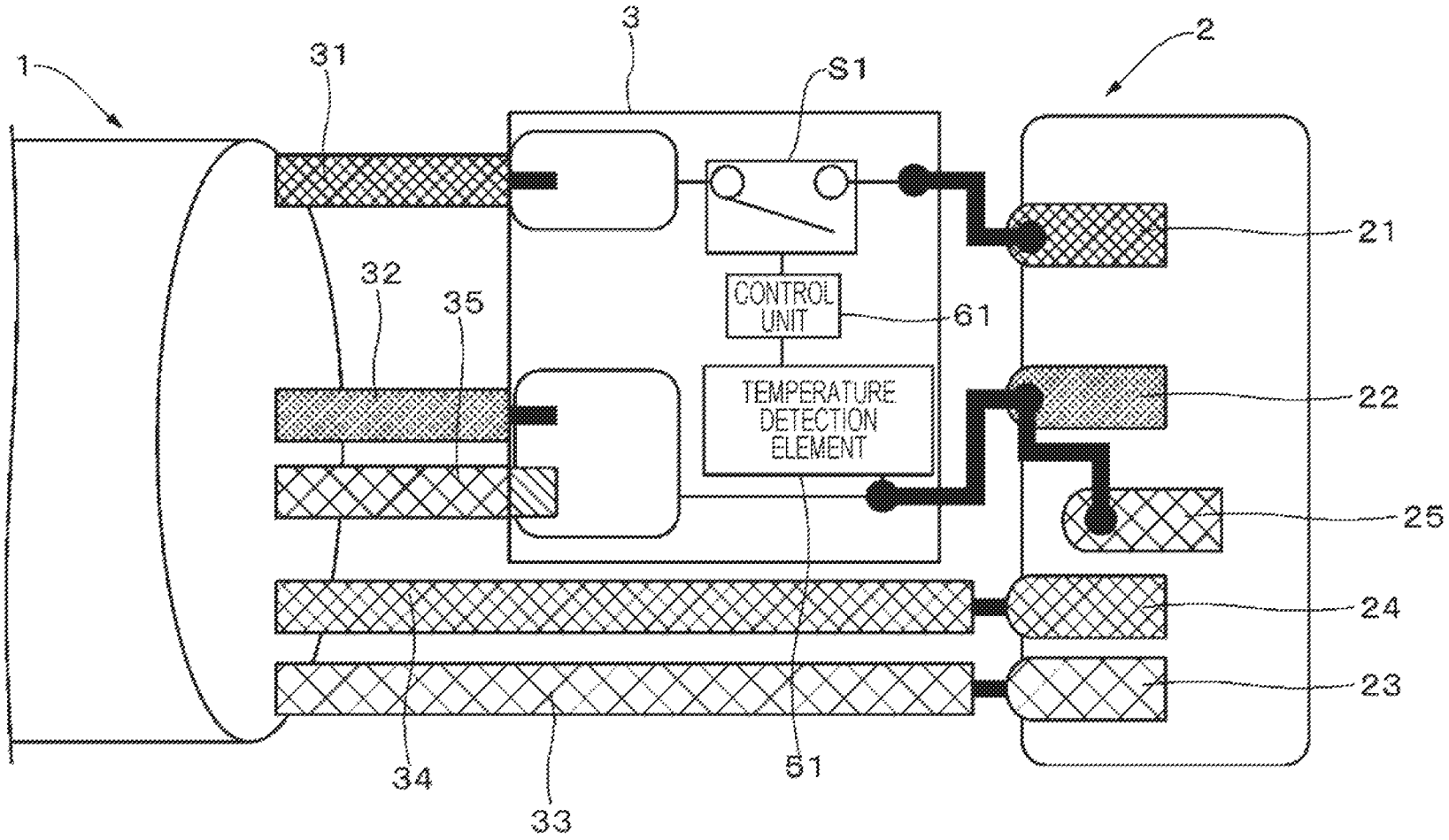
FIG. 7 is a schematic diagram illustrating a second example of another configuration of the protection circuit.

FIG. 7 is a schematic diagram illustrating a second example of another configuration of the protection circuit. A switch S1 is provided on a positive power line. In variation 1-3, a control unit 61 is connected to the switch S1. The control unit 61 is formed of a microcomputer, for example. When the control unit 61 monitoring a resistance value or the like of a temperature detection element 51 detects abnormal temperature, for example, the control unit performs control to turn off the switch S1 and interrupt the positive power line. At least the cable can thus be protected against the abnormal increase in temperature. For example, the cable as well as the power supply source connected to the cable and the device connected to the cable to receive power supply can be protected against the abnormal increase in temperature caused by the abnormal heating or the like. The rest is similar to the aforementioned example and variation 1-1 of the cable. Note that variation 1-2 may similarly be configured to have the control unit 61 added to the protection circuit.

The cable can solely perform a protection operation in the first embodiment of the present technology described above. While a typical USB charging-compatible AC adapter performs the protection operation (which stops output at the time of excessive output current or an abnormal increase in temperature) typically on the side of an AC adapter, for example, the present technology can perform the protection operation solely by the cable without the AC adapter or the like. Moreover, the cable can perform heat detection and protection solely without sacrificing a data communication line or adding wire for temperature detection.

Moreover, the first embodiment of the present technology has an effect superior to the typical protection operation. That is, according to the technology in which the AC adapter performs the protection operation, protection cannot be performed in the event of abnormal heating of a USB connector in an imperfect state so that the power supply (AC adapter) being the power supply source, the USB cable and set equipment cannot be protected, the imperfect state corresponding to an abnormality in the connector terminal of the USB cable, intrusion of a foreign matter, and/or defective contact.

It is also possible to adopt a technique of attaching a temperature sensor to the side of the cable and causing the AC adapter to turn off power upon being notified of abnormal temperature, in which case a communication line for the USB cable needs to be added. The protection operation cannot be performed solely by the cable, either.

On the other hand, according to the first embodiment of the present technology, the cable can solely perform the protection by a method independent of the AC adapter and the power supply. Moreover, the first embodiment of the present technology is adapted to detect the temperature of abnormal heating, not current or voltage such as excessive current or voltage, so that the abnormal heating can be detected promptly to interrupt the current. In the first embodiment of the present technology, the heat can be detected promptly and reliably in the event of the abnormal heating of the USB connector in the imperfect state even within a rated range (rated voltage or rated current) of the AC adapter and the power supply, whereby the current can be shut off to stop the heating to be able to protect the power supply (AC adapter) being the power supply source, the USB cable and the set equipment, the imperfect state corresponding to the abnormality in the connector terminal, intrusion of the foreign matter and/or defective contact. The first embodiment of the present technology is effective as protection to guarantee safety of a user since the operation can be stopped safely to detect heat and stop independently of the AC adapter and the power supply before the USB cable or the connector on the set side begins to melt or smoke by abnormal heating of the USB connector. Moreover, the cable can be used safely without affecting the AC adapter and the power supply.

2. Second Embodiment

An example of the configuration of a cable according to a second embodiment of the present technology will be described.

The example of the cable according to the second embodiment of the present technology includes a cable part 1 and a connector 2 as with the first embodiment, for example. The connector 2 is provided at one end of the cable part 1. A connector different in type from the connector 2 is provided at another end of the cable part 1.

Figure 8A:
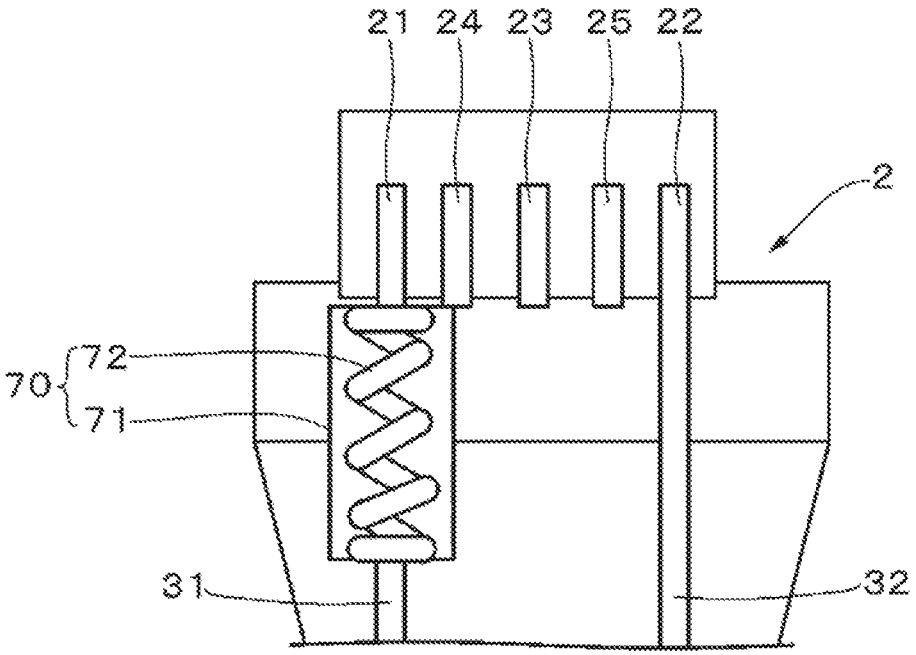
FIGS. 8A and 8B are schematic diagrams each illustrating a schematic configuration of the connector.
Figure 8B:
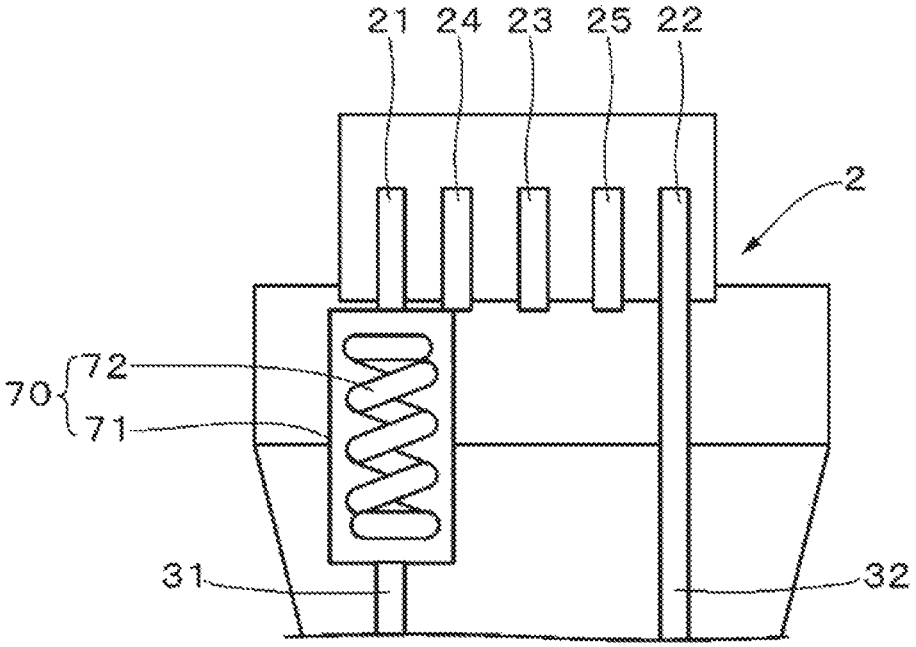

FIGS. 8A and 8B are schematic diagrams each illustrating a schematic configuration of the connector 2. Note that FIG. 8A illustrates a state before a protection operation is performed, while FIG. 8B illustrates a state after the protection operation is performed. Note that a D+ line 33 electrically connected to a D+ terminal 23 and a D− line 34 electrically connected to a D− terminal 24 are omitted in FIGS. 8A and 8B.

A GND line 32 is electrically connected to a GND terminal 22. A VBUS line 31 is electrically connected to a VBUS terminal 21 via a protection member 70.

The protection member 70 includes a case 71 made of insulating material or the like and an extensible conductor member 72 accommodated in the case 71 and made of material such as a shape memory alloy that changes in shape according to temperature. The protection member 70 is incorporated in the connector 2, for example. Note that the protection member 70 may instead be incorporated in the cable part 1 or across both the connector 2 and the cable part 1.

The extensible conductor member 72 is, for example, a spring-like shape memory alloy with a characteristic of expanding at temperature (such as low temperature and room temperature) of a normal operation and contracting at high temperature. The protection member 70 is installed in series with a positive power line to switchably conduct and interrupt the positive power line by a change in shape such as expansion and/or contraction of the extensible conductor member 72.

As illustrated in FIG. 8A, for example, the extensible conductor member 72 expands in a state at the temperature (such as low temperature and room temperature) of the normal operation, where both ends of the extensible conductor member 72 are electrically connected to the VBUS line 31 and the VBUS terminal 21, respectively. An opening is provided on each of one end face and another end face of the case 71, for example, so that the VBUS line 31 and the VBUS terminal 21 are brought into contact with one end and another end of the extensible conductor member 72 through the opening to be electrically connected therewith, respectively.

When an abnormal increase in temperature or the like results in a high temperature state, as illustrated in FIG. 8B, the positive power line is interrupted by the change in shape such as the contraction of the extensible conductor member 72. The contraction of the extensible conductor member 72 releases the contact between each of the VBUS line 31 and the VBUS terminal 21 and each of the one end the other end of the extensible conductor member 72 to interrupt the positive power line, for example. At least the cable can thus be protected against the abnormal increase in temperature. For example, the cable as well as the power supply source connected to the cable and the device connected to the cable to receive power supply can be protected against the abnormal increase in temperature caused by the abnormal heating or the like. In the second embodiment of the present technology, the cable can solely perform the protection operation as with the first embodiment.

[Variation 2-1]

The example of the cable according to the second embodiment may also be adapted such that the arrangement of the protection member 70 is changed as follows.

Figure 9A:
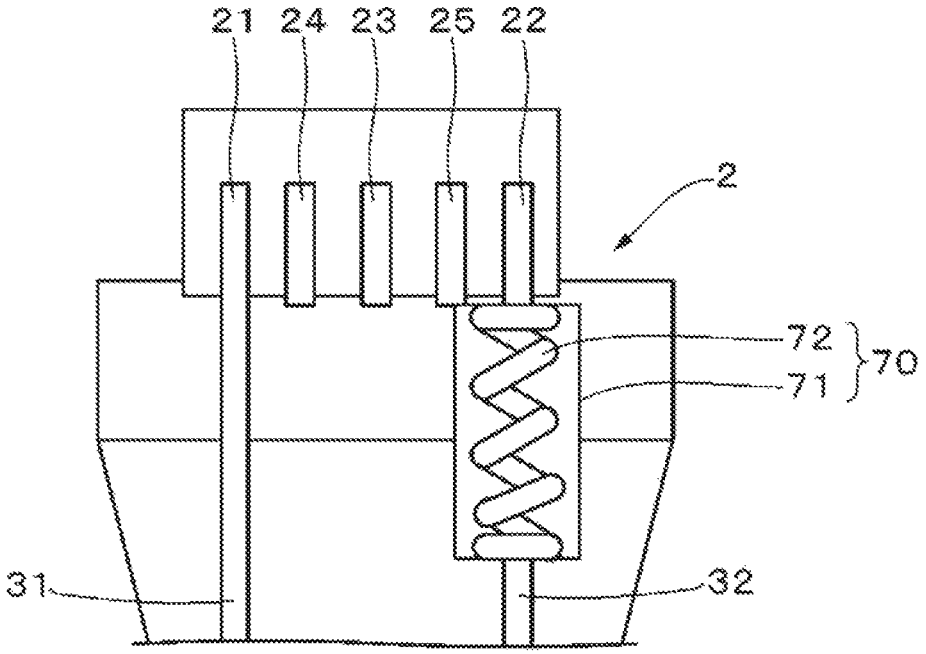
FIGS. 9A and 9B are schematic diagrams each illustrating a schematic configuration of the connector.
Figure 9B:
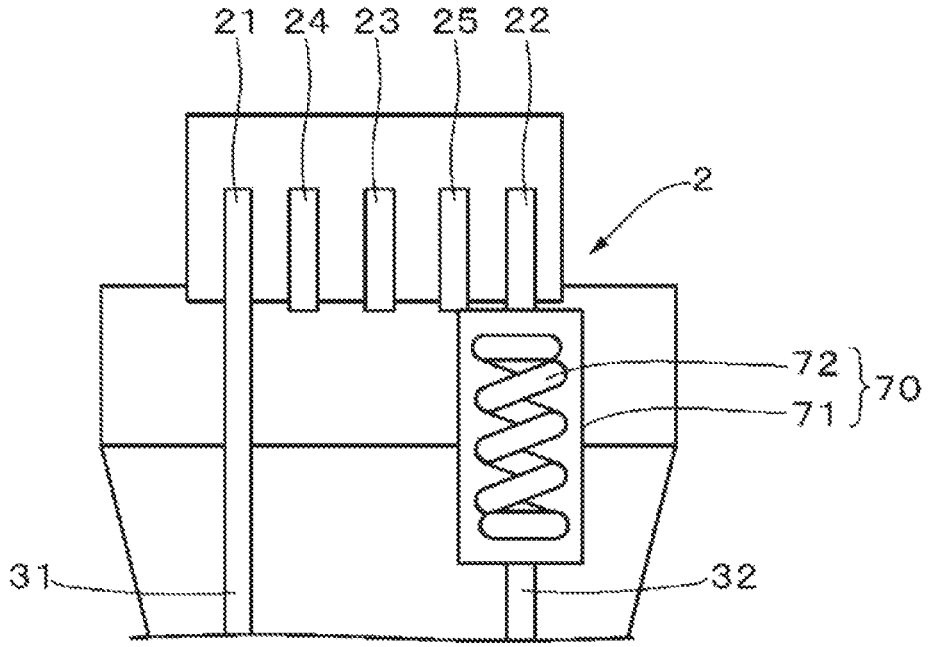

FIGS. 9A and 9B are schematic diagrams each illustrating a schematic configuration of a connector 2. Note that FIG. 9A illustrates a state before a protection operation is performed, while FIG. 9B illustrates a state after the protection operation is performed. Note that a D+ line 33 electrically connected to a D+ terminal 23 and a D− line 34 electrically connected to a D− terminal 24 are omitted in FIGS. 9A and 9B.

In variation 2-1, a VBUS line 31 is electrically connected to a VBUS terminal 21. A GND line 32 is electrically connected to a GND terminal 22 via a protection member 70. The protection member 70 is installed in series with a negative power line to switchably conduct and interrupt the negative power line by a change in shape such as expansion and/or contraction of an extensible conductor member 72.

As illustrated in FIG. 9A, for example, the extensible conductor member 72 expands in a state at temperature (such as low temperature and room temperature) of a normal operation, where both ends of the extensible conductor member 72 are electrically connected to the GND line 32 and the GND terminal 22, respectively.

When an abnormal increase in temperature or the like results in a high temperature state, as illustrated in FIG. 9B, the negative power line is interrupted by the change in shape such as the contraction of the extensible conductor member 72. At least the cable can thus be protected against the abnormal increase in temperature. For example, the cable as well as the power supply source connected to the cable and the device connected to the cable to receive power supply can be protected against the abnormal increase in temperature caused by the abnormal heating or the like.

The second embodiment of the present technology described above has an effect similar to that of the first embodiment. In the second embodiment of the present technology, the cable can solely perform the protection operation without using a temperature detection element such as a thermistor.

3. Third Embodiment

A cable according to a third embodiment of the present technology will be described. There will be described an example in which the cable according to the third embodiment is applied to a power supply device. There will be described an example of the configuration of the power supply device in which an end of the cable is connected to an AC adapter, for example.

Figure 10:
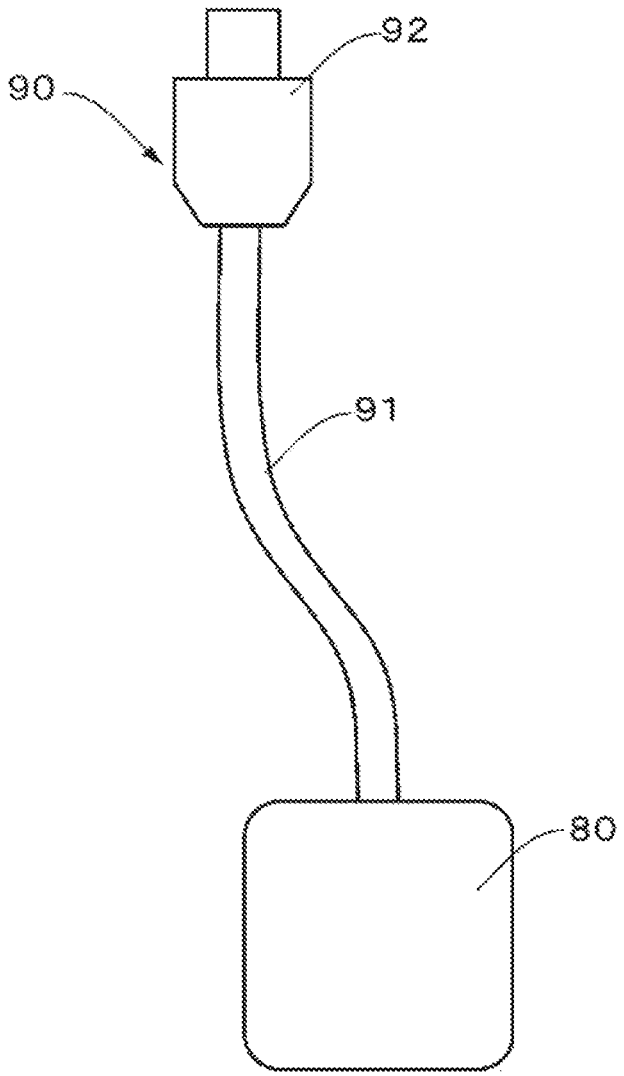
FIG. 10 is a schematic diagram illustrating a schematic configuration of a power supply device according to a third embodiment.

FIG. 10 is a schematic diagram illustrating a schematic configuration of the aforementioned power supply device. The power supply device includes an AC adapter 80 and a cable 90 connected to the AC adapter 80. The cable 90 includes a cable part 91 and a connector 92 provided at one end of the cable part 91. A connector that is different in type from the connector 92 and connected to the AC adapter 80 is provided at another end of the cable part 91. Note that the cable part 91 may be connected to the AC adapter 80 without the connector.

Figure 11A:
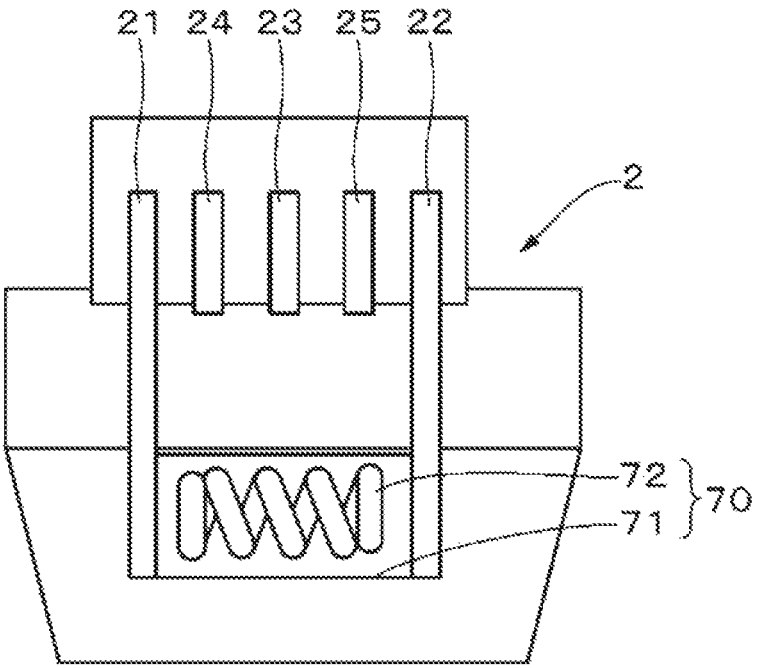
FIGS. 11A and 11B are schematic diagrams each illustrating a schematic configuration of a connector.
Figure 11B:
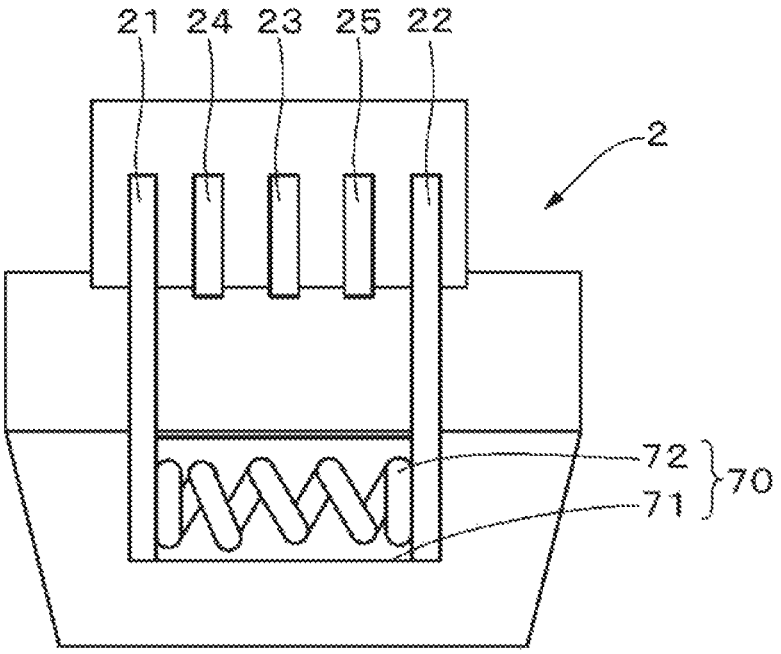

FIGS. 11A and 11B are schematic diagrams each illustrating a schematic configuration of the connector 92. Note that FIG. 11A illustrates a state before a protection operation is performed, while FIG. 11B illustrates a state after the protection operation is performed. Note that a D+ line 33 electrically connected to a D+ terminal 23 and a D− line 34 electrically connected to a D− terminal 24 are omitted in FIGS. 11A and 11B.

An extensible conductor member 72 is, for example, a spring-like shape memory alloy with a characteristic of contracting at temperature (such as low temperature and room temperature) of a normal operation and expanding at high temperature. As illustrated in FIG. 11A, the extensible conductor member 72 contained in a case 71 of a protection member 70 contracts at the temperature (such as low temperature and room temperature) of the normal operation, in which case a positive power line and a negative power line are not short circuited by the extensible conductor member 72. On the other hand, in the event of a high temperature state caused by an abnormal increase in temperature or the like, the extensible conductor member 72 expands as illustrated in FIG. 11B to cause both ends of the extensible conductor member 72 to be electrically connected to the positive power line and the negative power line, which are short circuited by the extensible conductor member 72. Accordingly, an increased amount of current flowing to the AC adapter 80 causes a protection circuit included in the AC adapter 80 to actuate an overcurrent protection operation to be able to stop output of the AC adapter 80. As a result, at least the cable can be protected against the abnormal increase in temperature. The cable as well as the AC adapter 80 connected to the cable and a device connected to the cable to receive power supply can be protected, for example. Note that unless the temperature drops to the temperature of deformation after the high temperature state, the extensible conductor member stays expanded to keep the positive power line and the negative power line short circuited by the extensible conductor member 72.

4. Fourth Embodiment

A cable according to a fourth embodiment of the present technology will be described. There will be described an example in which the cable according to the fourth embodiment is applied to a power supply device. There will be described an example of the configuration of the power supply device in which an end of the cable is connected to an AC adapter, for example. The power supply device includes an AC adapter 80 and a cable 100 connected to the AC adapter 80. The cable 100 includes a cable part 101 and a connector 102 provided at one end of the cable part 101. A connector that is different in type from the connector 102 and connected to the AC adapter 80 is provided at another end of the cable part 101. Note that the cable part may be connected to the AC adapter 80 without the connector.

Figure 12:
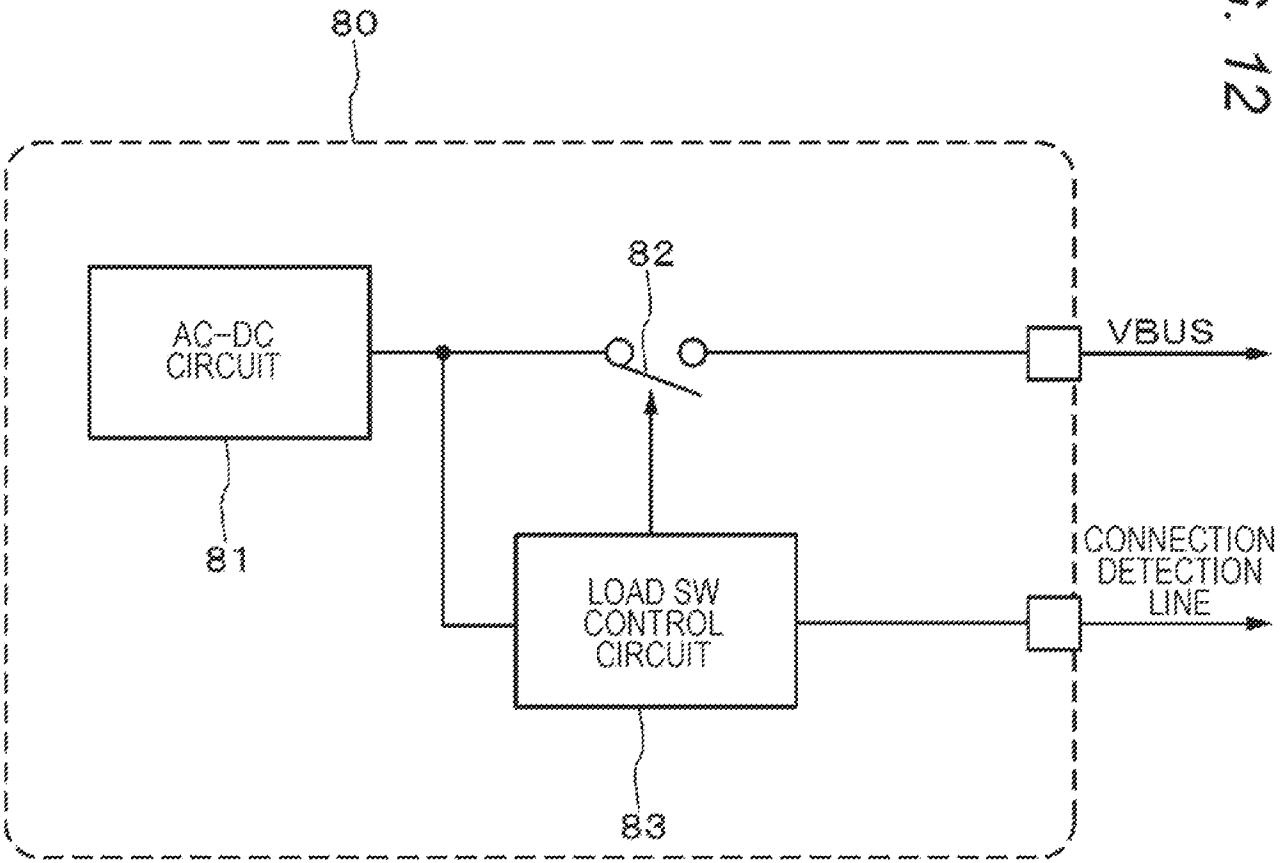
FIG. 12 is a schematic diagram illustrating a schematic electrical configuration of an AC adapter.

FIG. 12 is a schematic diagram illustrating a schematic electrical configuration of the AC adapter. An alternating current supplied from an external power supply to the AC adapter 80 is converted into a direct current by an AC-DC circuit 81, and then power is supplied through a power line via a connector 102. A switch S82 is connected to a VBUS line 31 forming a positive power line of the cable 100. The switch S82 is turned on and off under control of a load switch control circuit 83.

(Cable Part)

A cable part 101 includes the VBUS line 31 forming the positive power line and a GND line 32 forming a negative power line as power supply lines, a D+ line 33 and a D− line 34 as two positive and negative data communication lines for signal transmission, a shield line 35, and a connection detection line 36 for detecting connection.

(Connector)

Figure 13:
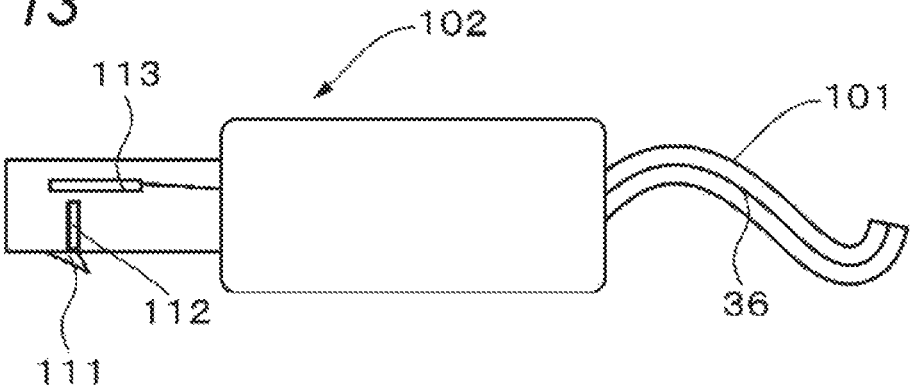
FIG. 13 is a side view illustrating a schematic configuration of the connector as viewed from the side.

FIG. 13 is a side view illustrating a schematic configuration of the connector as viewed from the side. A metal portion at the tip of a connector 102 is provided with a claw 111 being a protrusion formed on the underside of the metal portion to be able to move upward, a connection portion 112 that can move upward together with the claw 111 moving upward, and a connection detection terminal 113 connected to the connection detection line 36 of the cable part 101. When the connector 102 is inserted into a connector insertion port, for example, the claw 111 moves upward and pushes up a bottom face of the connection portion 112, which then moves upward. As a result, an upper end of the connection portion 112 and the connection detection terminal 113 are short circuited. A shield (metal portion at the tip) electrically connected to the connection portion 112 is connected to GND, where connection of the connector is detected when potential of the connection detection line drops to a GND level. Power supply on the positive power line (VBUS line) is stopped when it is detected that the connector 102 is not connected to a device. The power supply is switched on and off by controlling the switch S82 provided on the positive power line with use of a detection signal, for example. Therefore, the occurrence of an abnormal state while the connector 102 is not connected to an electronic device or the like can be prevented.

5. Another Embodiment

The present technology is not limited to the aforementioned embodiments of the present technology, where various modifications and applications can be performed without departing from the gist of the present technology.

The numerical value, structure, shape, material, raw material, manufacturing process and the like of the aforementioned embodiments are provided by way of example only, where a numerical value, a structure, a shape, material, raw material, a manufacturing process and the like different from those of the aforementioned embodiments may be used as appropriate, for example.

Moreover, the configuration, method, process, shape, material, numerical value and the like of the aforementioned embodiments can be combined with one another without departing from the gist of the present technology.

The connectors provided at the one end and the other end of the cable part 1 of the cable may be of the same type, for example. In the second embodiment, for example, the protection member 70 may be installed on both the positive power line and the negative power line. In the second embodiment, for example, a fuse may be used in place of the protection member 70.

Moreover, as one example of another embodiment, there can be adopted a configuration in which a thermistor is installed near the connector on the device side connected to the USB cable. A known technology adopts a circuit in which the thermistor is installed near a battery so that charging is stopped when the battery becomes hot. A similar circuit can be used to stop charging when the thermistor near the connector on the device side detects high temperature, while at the same time a stop signal is transmitted to the adapter side to stop power supply from the adapter. The stop signal is transmitted in the following manner. (1) Use signal lines for D+/D− that are unused when a dedicated charging port (DCP) is not used in normal USB 2.0/USB 3.0 standards. (2) Add a signal line used for the stop signal to the cable, or (3) In a standard performing communication with the adapter side such as USB PD/EVP/Quick Charge 2.0 (QC 2.0), a communication signal for these standards can also be used. According to the example of the other embodiment, at least the cable can be protected against abnormal heating at the time of device connection. The cable as well as the adapter being a power supply source connected to the cable and the device connected to the cable to receive power supply can be protected against abnormal heating, for example. The temperature detection element is provided on the device side, in which case there is an advantage that the cable part and the connector do not require processing.

REFERENCE SIGNS LIST

1 Cable part
2 Connector
3 Substrate

11 Connector body
12 Connector shell
21 VBUS terminal
22 GND terminal
23 D+ terminal
24 D− terminal
25 ID terminal
31 VBUS line
32 GND line
33 D+ line
34 D− line
35 Shield line
36 Connection detection line
51 Temperature detection element
52 Resistance
61 Control unit
70 Protection member
71 Case
72 Extensible conductor member
80 AC adapter
81 AC-DC circuit
83 Load switch control circuit
90 Cable
91 Cable part
92 Connector
100 Cable
101 Cable part
102 Connector
S1, S82 Switch

The invention claimed is:

1. A cable, comprising:
a cable part that includes:
a power supply line;
a first end;
a second end; and
a circuit board that comprises a protection circuit, the protection circuit including:
a temperature detection element; and
a switch directly connected to the temperature detection element,
wherein the switch is configured to accept a detection result of the temperature detection element to switchably conduct or interrupt the power supply line; and
a connector on at least one of the first end or the second end of the cable part,
wherein the connector comprises a shield electrically connected within the cable to a negative power line of the power supply line, and to one of the switch or the temperature detection element.

2. The cable according to claim 1, wherein the protection circuit further comprises a control unit configured to:
detect the detection result of the temperature detection element; and
control an operation of the switch based on the detected detection result.

3. The cable according to claim 1, wherein the cable is compliant with a universal serial bus (USB) standard.

4. A power supply device, comprising:
a power supply source; and
a cable configured to connect to the power supply source, wherein the cable comprises:
a cable part that includes:
a power supply line;
a first end;
a second end; and
a circuit board that comprises a protection circuit, the protection circuit including:
a temperature detection element; and
a switch directly connected to the temperature detection element, wherein the switch is configured to accept a detection result of the temperature detection element to switchably conduct or interrupt the power supply line; and
a connector on at least one of the first end or the second end of the cable part,
wherein the connector comprises a shield electrically connected within the cable to a negative power line of the power supply line, and to one of the switch or the temperature detection element.

5. The cable according to claim 1, wherein
the connector further comprises:
a body; and
a shell attached to the body, and
a portion of the shell is exposed for connection.

* * * * *